US006402625B2

(12) United States Patent
Armstrong

(10) Patent No.: US 6,402,625 B2
(45) Date of Patent: Jun. 11, 2002

(54) MOTION LINKAGE APPARATUS

(76) Inventor: Martin Armstrong, 7643 - 92 Avenue, Edmonton (CA), T6E 1R3

( * ) Notice: Subject to any disclaimer, the term of this patent is extended or adjusted under 35 U.S.C. 154(b) by 0 days.

(21) Appl. No.: 09/736,453

(22) Filed: Dec. 15, 2000

(51) Int. Cl.[7] ..... A63G 31/16
(52) U.S. Cl. ..... 472/59; 472/130; 434/55
(58) Field of Search ..... 472/59, 57, 60, 472/61, 130; 434/55, 58; 248/370

(56) References Cited

U.S. PATENT DOCUMENTS

| | | | | |
|---|---|---|---|---|
| 2,801,496 A | * | 8/1957 | Borsos | 434/58 |
| 3,494,052 A | | 2/1970 | Corlvon | |
| 3,584,429 A | | 6/1971 | Stevning | |
| 3,967,387 A | | 7/1976 | Marchegiani | |
| 4,019,261 A | | 4/1977 | Pancoe | |
| 4,978,299 A | | 12/1990 | Denne | |
| 5,176,518 A | * | 1/1993 | Hordijk et al. | 434/37 |
| 5,545,040 A | | 8/1996 | Lu | |
| 5,901,936 A | | 5/1999 | Bieg | |
| 5,911,634 A | | 6/1999 | Nidata et al. | |

* cited by examiner

*Primary Examiner*—Kien T. Nguyen
(74) *Attorney, Agent, or Firm*—Bennett Jones LLP

(57) ABSTRACT

A motion translating apparatus which may be used in a motion simulator or in a motion controlling device has an x axis, a y axis and a z axis, each of which axes is perpendicular to each other. The apparatus may include a base having a central leg substantially in the "z" axis; at least three shaft and ball assemblies associated with each leg, each assembly including a ball having a spherical outer surface and a centerline parallel to the "x-y" plane, and a rotating shaft fixed to the ball parallel to but offset from the centerline of the ball; wherein the axes of the shafts converge on a center point and radiate outward from the leg and wherein rotation of the shaft displaces the ball eccentrically about the axis of the shaft; and a platform which has an outer circumference and at least three receptacles, wherein each receptacle engages a corresponding ball such that movement of each ball causes movement of the platform; and motor and gear mechanisms for independently rotating each shaft associated with the base or legs.

11 Claims, 16 Drawing Sheets

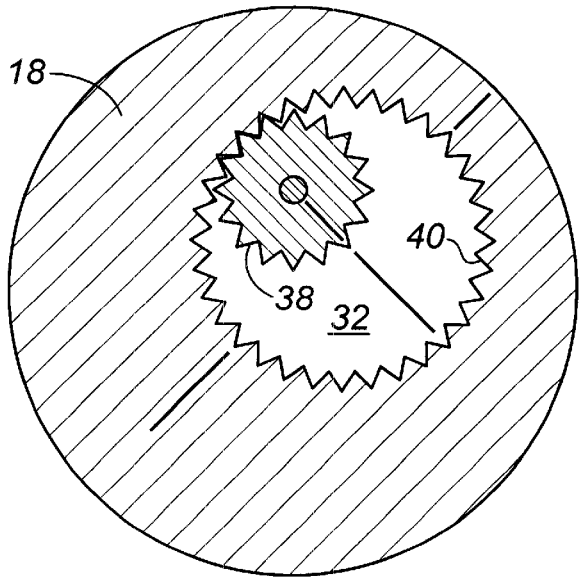
FIG. 5C
FIG. 6
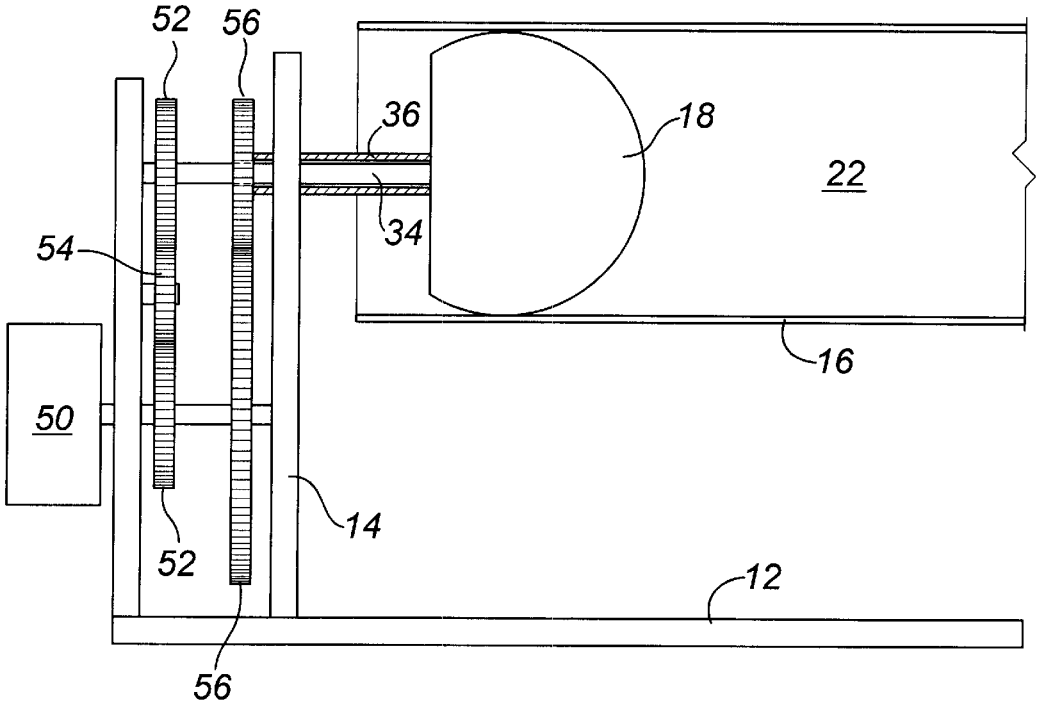

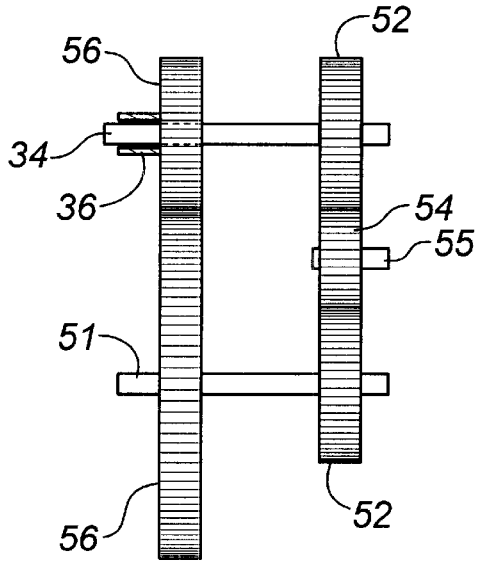
FIG. 6A
FIG. 7
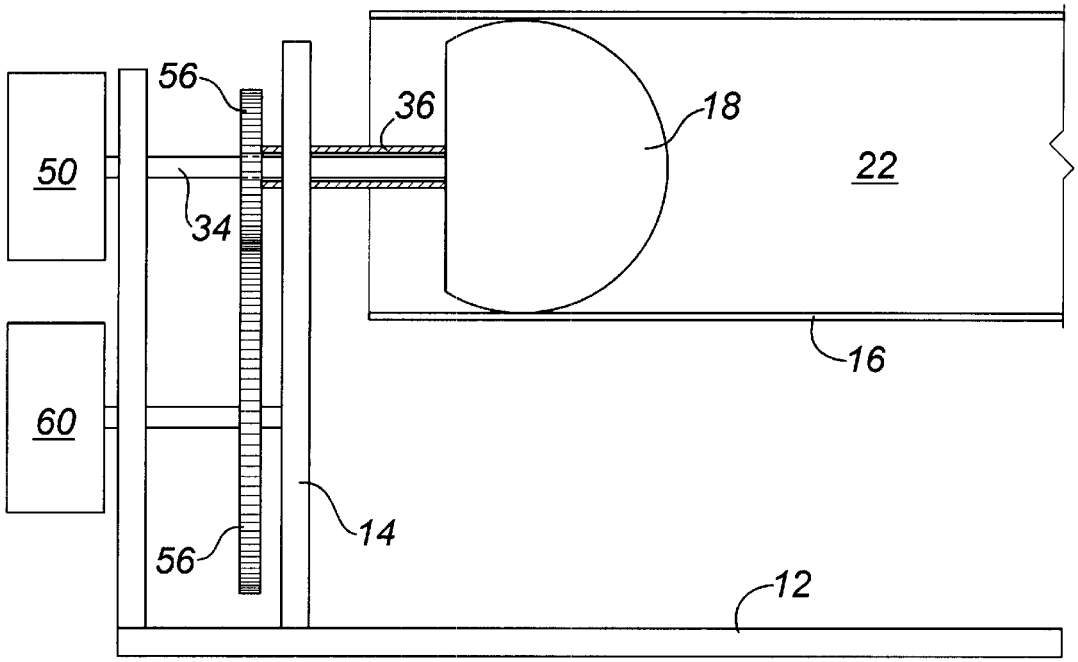

MOTION LINKAGE APPARATUS

FIELD OF THE INVENTION

The present invention relates to an apparatus for producing motion-simulating movement of a platform. It also relates to an apparatus for producing a signal from movement of a controller.

BACKGROUND OF THE INVENTION

Many amusement devices simulate motion by providing a platform which moves multi-directionally while a user is seated on the platform. Movement of the platform may be along six degrees of freedom: translational movement along x, y and z axes and rotational movement about the x, y and z axes.

Typically, a platform will be mounted on hydraulic cylinders which tilt the platform. In that case, the platform may be tilted by rotating around the x and y axes and may also be lifted or lowered ie/translational movement along the z axis. In this case, the platform will only have three degrees of freedom of movement. Motion simulators which employ hydraulic cylinders may not be fast acting or may cause abrupt non-natural motions which are not realistic.

In another field of application, controllers for video games or remote control devices translate physical action into electrical signals which are then used to input into the game to create animated motion in the game or to control movement of a device. Typically, the controller is a joystick which may only be moved in two degrees of freedom and therefore which responds to movement which controls movement along the x and y axes. If three-dimensional control is required, the controller must have a second joystick or other secondary controllers.

There is a need in the art for a motion linkage which may allow for translation of motion in at least three degrees of freedom and preferably all six degrees of freedom, either in creating motion in the case of a motion simulator or by translating motion in the case of a controller such as a joystick.

SUMMARY OF THE INVENTION

The present invention is directed to a motion translating apparatus which may be used in a motion simulator or in a motion controlling device.

Accordingly, in one aspect of the invention, the invention comprises a motion linkage apparatus having an x axis, a y axis and a z axis, each of which axes is perpendicular to each other, said apparatus comprising:

(a) a base having a central leg substantially in the "z" axis;

(b) at least three shaft and ball assemblies associated with each leg, each assembly comprising:

i. a ball having a spherical outer surface and a centre-line parallel to the "x-y" plane; and ii. a rotating shaft fixed to the ball parallel to but offset from the centreline of the ball;

wherein the axes of the shafts converge on a centre point and radiate outward from the leg and wherein rotation of the shaft displaces the ball eccentrically about the axis of the shaft; and (c) a platform which has an outer circumference and at least three receptacles, wherein each receptacle engages a corresponding ball such that movement of each ball causes movement of the platform; and (d) means for independently rotating each shaft associated with the base or legs.

In a preferred embodiment, there are at least three legs located about a periphery of the base instead of a single central leg; at least three shaft and ball assemblies wherein each leg is associated with a shaft and ball assembly, wherein each shaft radiates inwardly and the axes of the at least three shafts converge at a central point; and at least three cylindrical sockets wherein each socket rotatably receives a ball.

In another aspect of the invention, the invention comprises a motion linkage apparatus having an x axis, a y axis and a "z" axis, each of which axes is perpendicular to the other axes, said apparatus comprising:

(a) a base having a central leg substantially in the "z" axis;

(b) at least three ball and cam assemblies associated with the leg, each comprising:

i. a ball having a spherical exterior surface, a centreline parallel to the "x-y" plane and a cylindrical cavity having a centroidal axis which is parallel to but offset from the centreline of the ball;

ii. a cam which is rotatably mounted within the ball cavity;

iii. an inner shaft attached to the cam in an offset position, for rotating the cam about an axis defined by the inner shaft, wherein said inner shaft axis is coaxial with the centreline of the ball;

iv. an outer shaft which is coaxial with and which may rotate independently of the inner shaft, wherein said outer shaft has a fixed pinion gear and rotates the ball by means of the pinion gear meshing with a circular inner gear attached to the ball;

v. wherein the axes of the inner and outer shafts converge on a centre point and radiate outward; and vi. wherein rotation of the inner shaft relative to the outer shaft causes the centreline of the ball to be displaced relative to the axis of the inner and outer shafts;

(d) means for counter-rotating each inner shaft and a corresponding outer shaft such that the ball and cam counter-rotate at the same rate; and (e) a platform having at least three ball sockets wherein each ball rotatably engages a ball socket.

In a preferred embodiment, there are at least three legs located about a periphery of the base instead of a single central leg; at least three ball and cam assemblies wherein each leg is associated with a ball and cam assembly, wherein each shaft radiates inwardly and the axes of the at least three inner and outer shafts converge at a central point; and at least three cylindrical sockets wherein each socket rotatably receives a ball. The inner shafts may pass through each ball and may be supported by a strut which may be a single strut centrally located on the base.

In another embodiment, the apparatus may comprise the combination of two apparatuses as described herein which are joined together at their bases such that one is inverted to the other. In this embodiment, each shaft in one apparatus may be driven by a motor which also drives the equivalent shaft in the other apparatus.

In any embodiment, each inner shaft and each outer shaft may be rotated independently of each other such that platform may be moved in six degrees of freedom Alternatively, the apparatus may be adapted for use as remote control device or as a joystick-style controller and comprises a sensor or signal feedback device in replacement of the means for rotating the shafts.

BRIEF DESCRIPTION OF THE DRAWINGS

The invention will now be described by way of an exemplary embodiment with reference to the accompanying simplified, diagrammatic, not-to-scale drawings. In the drawings:

FIGS. 5A to 5C are schematic representations of movement of the ball in the z axis.

FIG. 6 is a side view of a single motor configuration of a leg.

FIG. 6A is a view of an alternative transmission configuration of a single motor embodiment.

FIG. 7 is a side view of a two motor configuration of a leg.

DETAILED DESCRIPTION OF THE INVENTION

The present invention provides for a motion translator apparatus. When describing the present invention, the following terms have the following meanings, unless indicated otherwise. All terms not defined herein have their common art-recognized meanings.

A. Definitions

The term "degree of freedom of motion" refers to the ability of the apparatus to create or translate motion along or rotationally about one of the x, y or z axes. Therefore, an apparatus which allows movement along and rotationally about each of the three axes will have six degrees of freedom of motion.

The six degrees of freedom are as follows, assuming that the x and y axes are horizontal, the z axis is vertical and the x axis defines forwards and backwards:

(a) rotational movement about the y axis ("pitch");

(b) rotational movement about the x axis ("roll");

(c) rotational movement about the z axis ("yaw");

(d) translational movement along the y axis ("sway");

(e) translational movement along the x axis ("surge"); and (f) translational movement along the z axis ("heave" or "thrust").

B. Description

The apparatus (10) according to the Figures comprises a motion translator which may be adapted to produce motion as a result of and corresponding to an input signal or which may be adapted to convert motion into an output signal. In the following description, the apparatus will be described and claimed with reference to an x axis, a y axis and a z axis, each of which axes is perpendicular to the other to create a 3-dimensional frame of reference. For ease of reference, the x and y axes will be referred to as being in the horizontal plane while the z axis will be vertical. It will be understood that references to vertical and horizontal are not intended to be limiting of the invention claimed herein.

Figure 1:
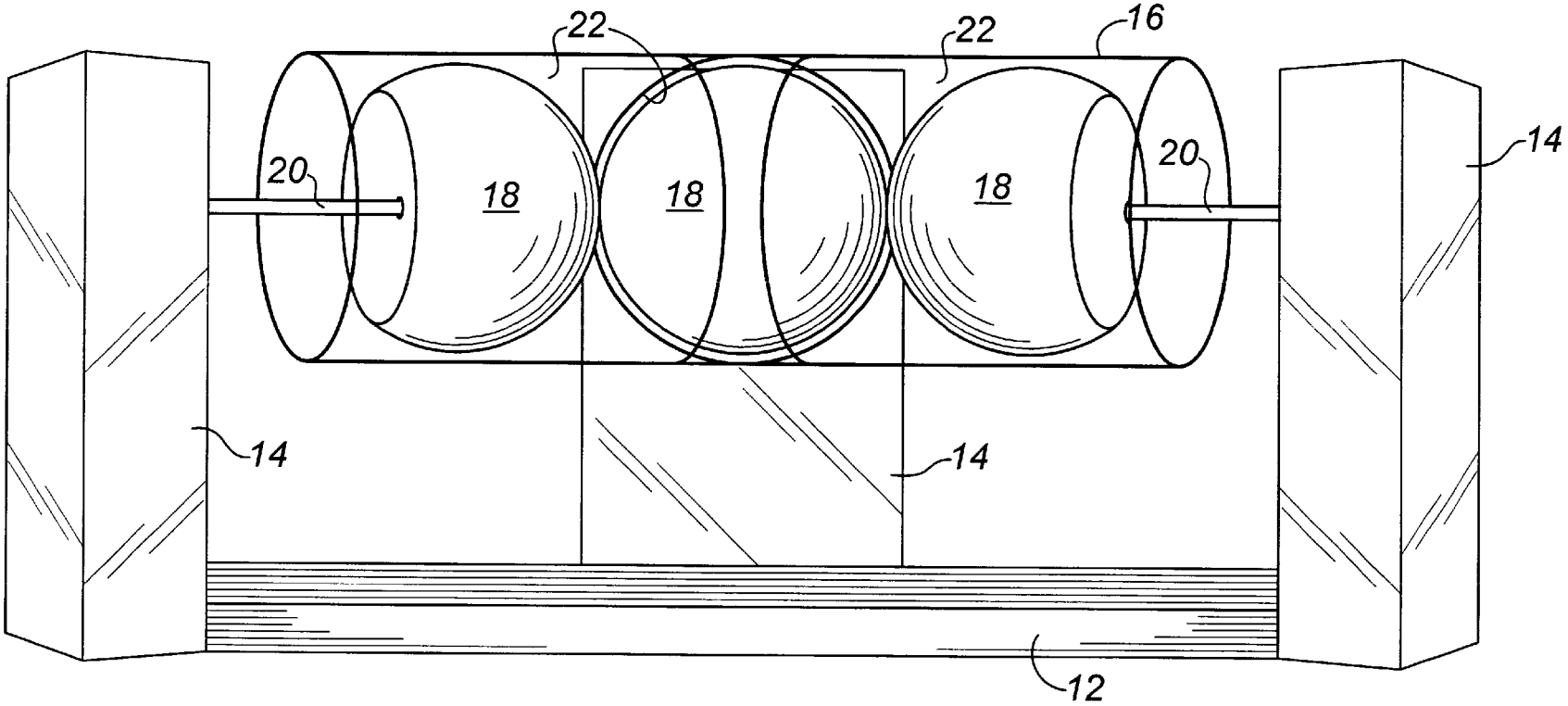
FIG. 1 is a view of an embodiment of a simplified aspect of the invention.

In the embodiment shown in FIG. 1, the apparatus (10) comprises a horizontal base (12) with three substantially vertical legs (14) and a horizontal platform (16). Each leg (14) has associated with it an assembly comprising a ball (18) and shaft (20) assembly where the shaft (20) extends horizontally inward from each leg (14) and the ball (18) is disposed on the end of each shaft (20). The shaft (20) is connected to the ball (18) offset from the horizontal centreline of the ball such that the ball acts as a cam when the shaft is rotated. The means for rotating each shaft may be enclosed within each corresponding leg and may be an electric motor which rotates the shaft by means of a belt drive or by gears within the leg.

The platform (16) includes a socket (22) for receiving each ball. The socket (22) is sized to closely match the diameter of the ball (18) but still allow the ball (18) to rotate freely within the socket (22). As is apparent, rotation of the shaft will cause eccentric rotation of the ball (18) about the axis of the shaft (20). As the ball rotates within the socket, the platform (16) will be caused to move relative to the base (12). It may then be seen that by coordinating the rotation of the three shafts, movement of the entire platform may be controlled.

This simple embodiment suffers from the disadvantage that smooth linear motion along one axis or plane is not possible because of the eccentricity of the camming action. For example, any movement along the z axis will always be accompanied by some movement along the x-y plane.

Figure 2:
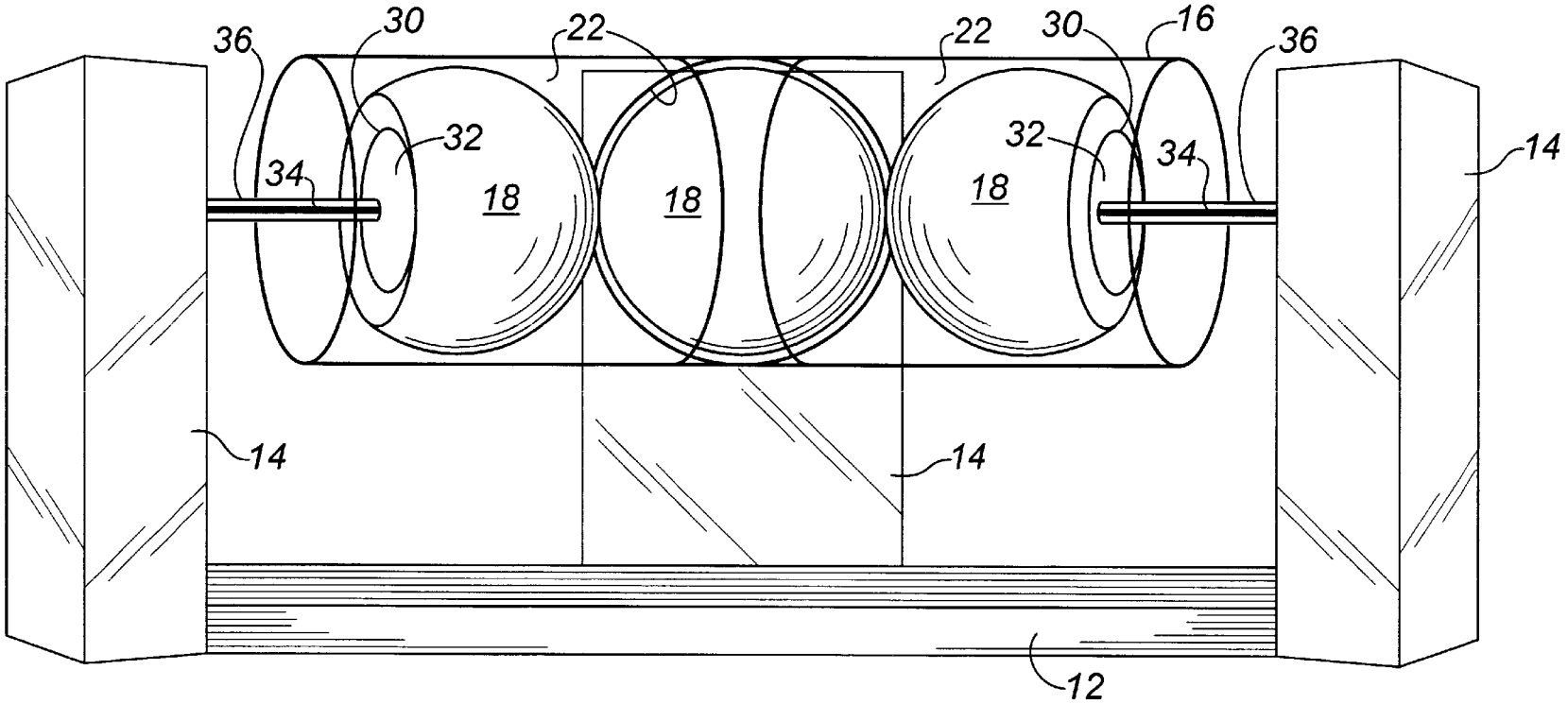
FIG. 2 is a view of one embodiment of the apparatus.
Figure 3:
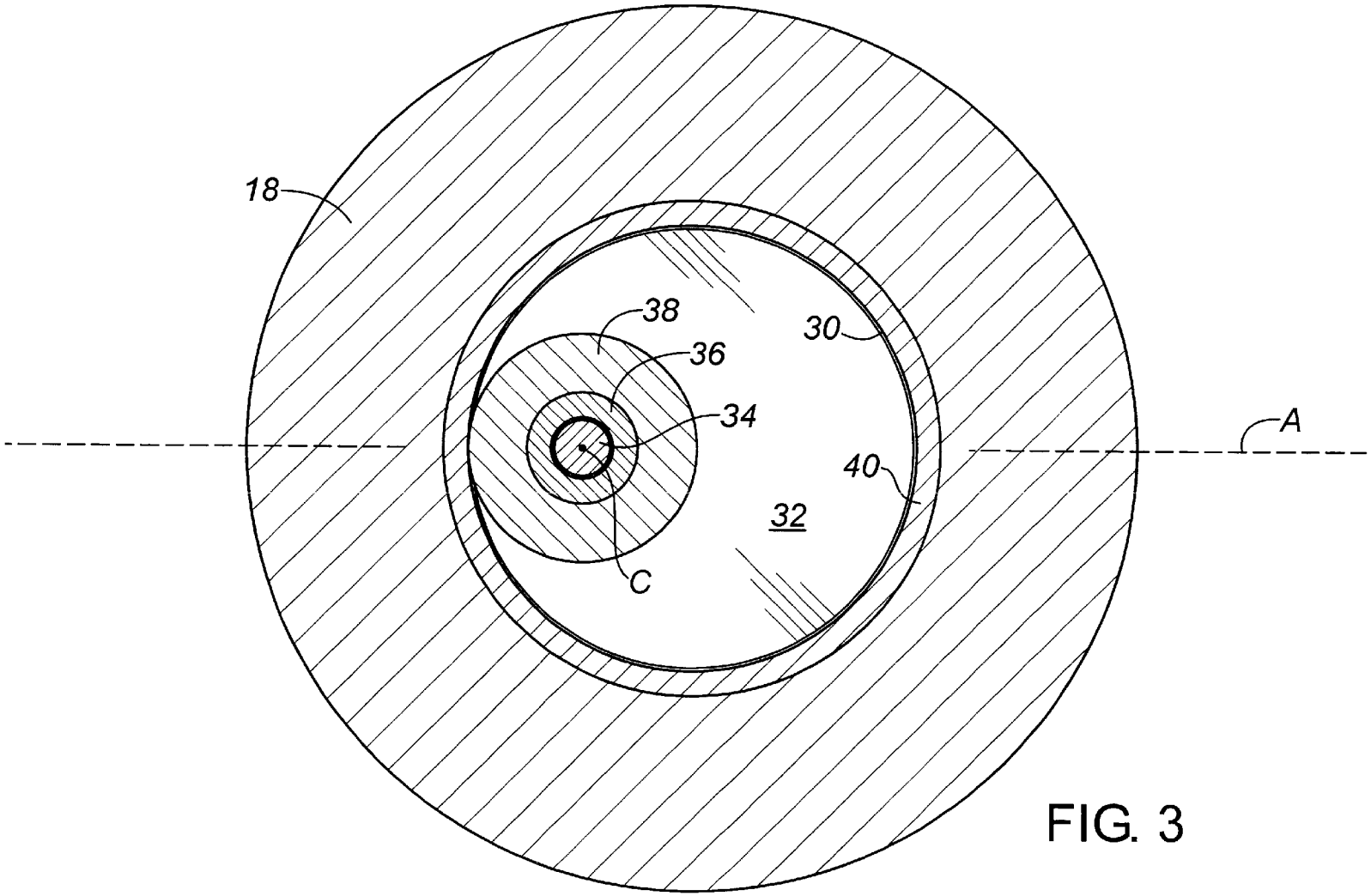
FIG. 3 is a is a front view of a ball cam assembly of the embodiment shown in FIG. 2.
Figure 4:
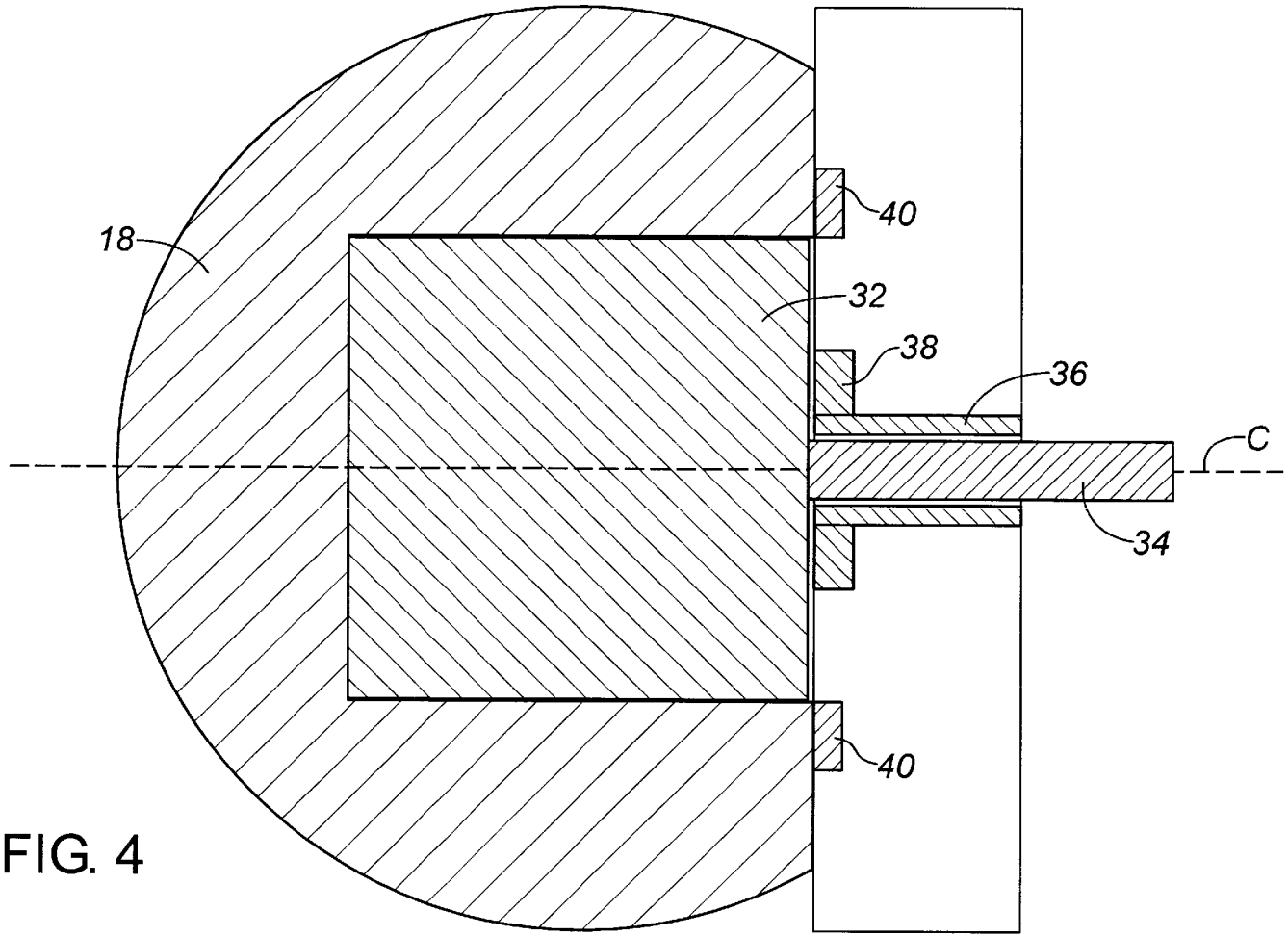
FIG. 4 is a side of the ball an cam assembly shown in FIG. 3.

The simple embodiment described above may be modified by replacing the direct shaft to ball connection with a ball and cam assembly described below, thereby permitting smooth linear movement in any direction. In this embodiment, each ball (18) has a cylindrical cavity (30) which is offset from the centreline ("L") of the ball as is shown in FIGS. 2 and 3. A cylindrical cam (32) which is matched to the cylindrical cavity (30) and which may freely rotate within the cavity (30) is attached to the inner shaft (34). In an initial neutral position, the axis of the inner shaft is coaxial with the centreline of the ball, as is shown in FIG. 3. An outer shaft (36) which is coaxial with the inner shaft (34) has a pinion gear (38) which engages a ring gear (40) affixed to the ball. Therefore, rotation of the outer shaft (36) causes rotation of the ball (18) while rotation of the inner shaft (34) causes rotation of the cam (32).

If the inner shaft (34) and the outer shaft (36) are counter-rotated, then the centreline of the ball will move linearly away from the shaft axis in a direction 90° from the offset axis ("A"). The direction of movement may be controlled by first rotating both the inner and outer shafts in the same direction to reorient the offset axis ("A") of ball into the desired direction. The offset axis is defined as the axis which passes through both the centre of the ball and the centre of the cam when the ball and cam assembly are in a neutral position as shown in FIG. 3.

Figure 5A:
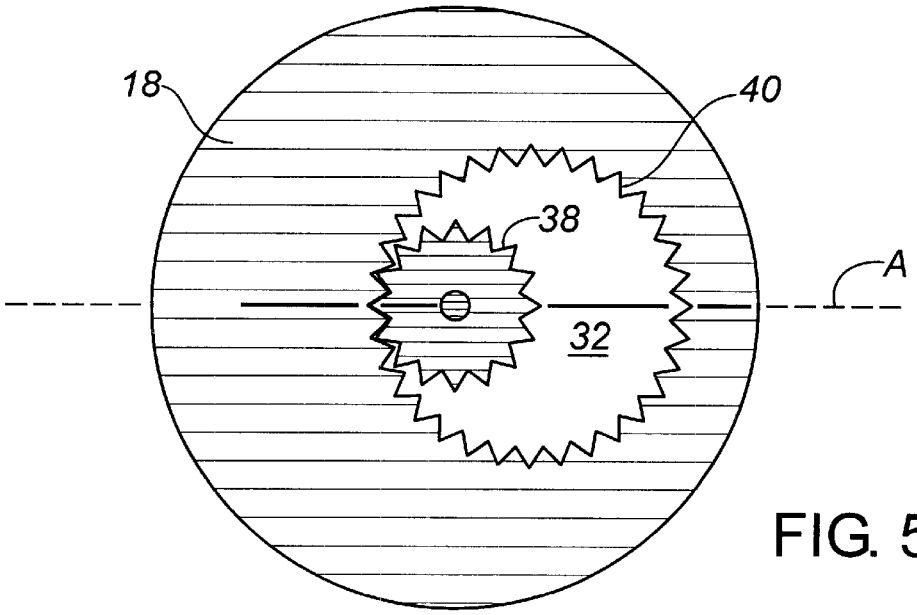
Figure 5B:
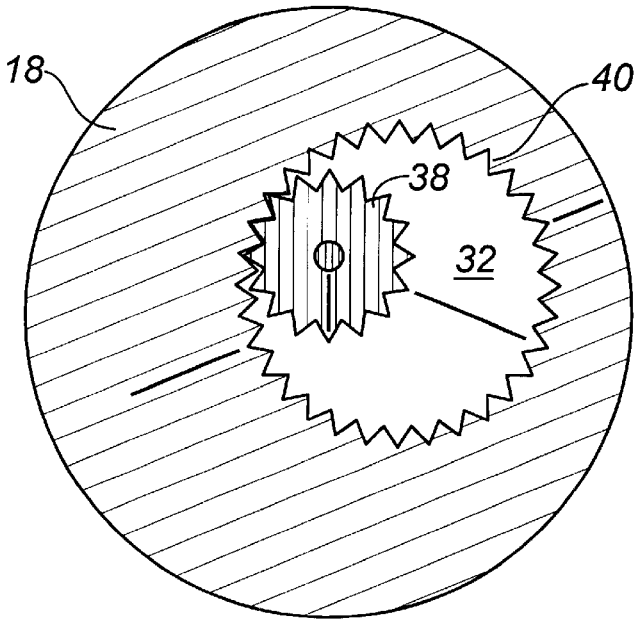

This motion is illustrated in FIGS. 5A to 5C. In the start position shown in FIG. 5A, the offset axis is horizontal (in the x-y plane), therefore, counter-rotation of the inner and outer shafts (34, 36) will move the ball in the z axis. In FIG.

5B, the inner shaft has rotated approximately 30° clockwise while the outer shaft has rotated approximately 90° counter-clockwise because of a 3:1 ratio of outer shaft rotation to inner shaft rotation. Because the inner shaft is directly connected to the cam, the cam will have rotated approximately 30° clockwise. Because of the 2:1 gearing from the pinion gear to the ring gear, the ball has rotated approximately 30° in the counter-clockwise direction, the same amount of rotation as the cam but in the opposite direction. As a result of the counter-rotation of the cam and ball, the ball will move downwards along the z axis. In FIG. 5C, the inner shaft and cam have rotated approximately 45° clockwise while the outer shaft has rotated approximately 135° thereby rotating the ball approximately 45° counter-clockwise.

As will be apparent, in order to have linear motion, the cam and the ball must counter-rotate at the same rate. Therefore, the gear ratios from the pinion gear to the ring gear and the relative rotation rates of the inner and outer shafts must be chosen to provide counter-rotation at the same rate. In the example shown, the gear ratio from the pinion gear to the ring gear is 2:1 while the outer shaft rotates three times faster than the inner shaft. Therefore in this particular example, the outer shaft must rotate three times faster than the inner shaft to maintain linear motion of the ball.

The means for rotating the shafts is shown in FIGS. 6, 6A and 7. A single motor (50) may be used to drive the inner and outer shafts of a single ball and cam assembly as is shown in FIG. 6. The motor (50) drives the inner shaft (34) by means of spur gears (52) and idler gear (54). The motor also drives the outer shaft by means of the two spur gears (56). The use of the idler gear (54) reverses the direction of rotation of the inner shaft (34) compared with the outer shaft (36).

As shown in FIG. 6A, the motor may drive the inner and outer shafts either at the connecting shaft (51), the idler shaft (55) or the inner shaft (34) itself.

Where there is only a single motor, the apparatus will only have three degrees of freedom. For example, if a single motor is used and the ball and cam assembly is oriented such that the offset axis is horizontal in the neutral position, then the ball may only move in the z axis. Therefore, an apparatus with three such ball and cam assemblies will be limited to pitch, roll and thrust movement.

Six degrees of freedom is possible if separate motors for each of the inner and outer shafts is used. In this embodiment, shown in FIG. 7, a motor (50) directly drives the inner shaft (34) while a separate motor (60) under separate control drives the outer shaft by means of the spur gears (56).

Figure 8:
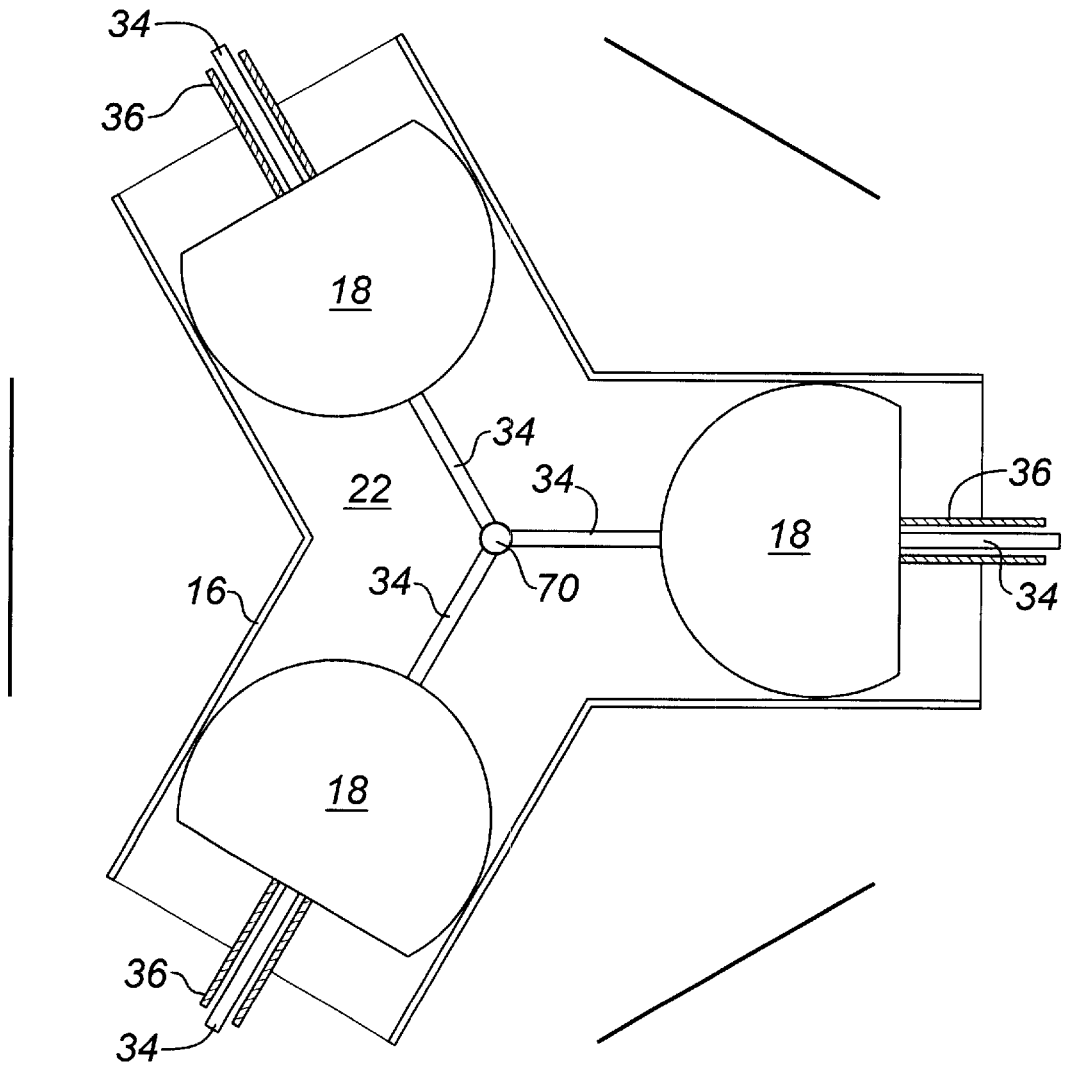
FIG. 8 is a top view of an alternative embodiment with a center strut.

The platform (16) illustrated is a tristar configuration comprising three cylindrical members joined together by a central portion as depicted in FIG. 8. Each of the cylindrical members is hollow, thereby defining the socket (22) within which a ball may be rotatably received. Of course, the platform (16) may take any configuration provided that sockets (22) are appropriately provided. For example, the platform may comprise a planar element (not shown) which has spherical sockets attached to the underside of the planar element.

In an alternative embodiment shown in FIG. 8, the inner shafts (34) may pass through the balls (18) and continue to a centre point where they meet the other inner shafts and where they may be supported by a centre strut (70). This embodiment may have reduced shaft flexing because of the centre support and have increased positional accuracy as a result. Of course, the balls (18) and possibly the sockets (22) will require appropriate openings to allow the inner shafts to pass through.

A central support such as a centre strut (70) may be necessary where the weight supported by the platform (16) may cause the inner and outer shafts to bend. Alternatively, or in addition to the use of struts to support the shafts, the platform may be counterbalanced by means of a coil spring or springs, or the like, disposed between the platform (16) and the base (12).

Figure 9:
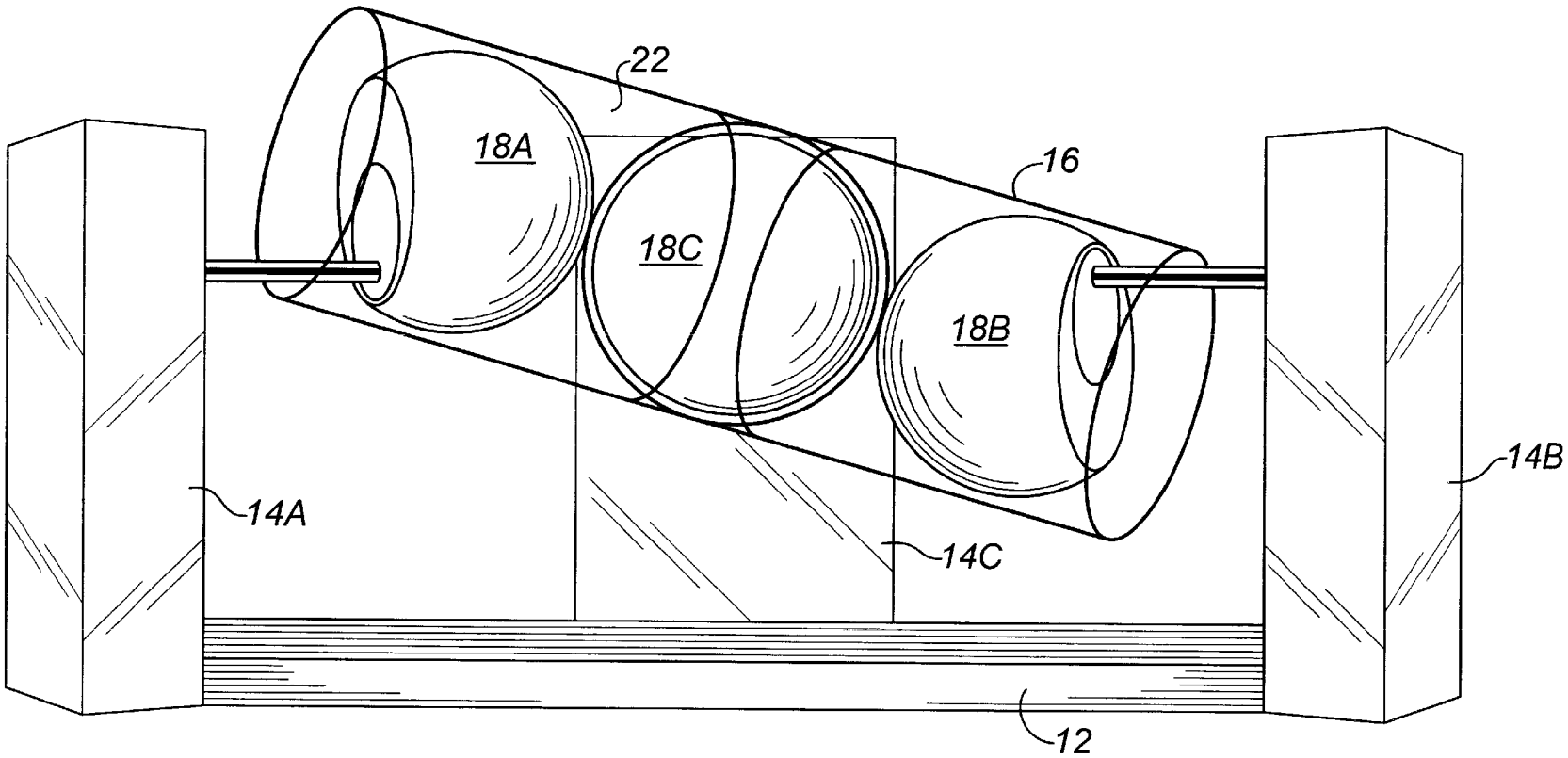
FIG. 9 is a view of the apparatus showing a rolling motion.
Figure 10:
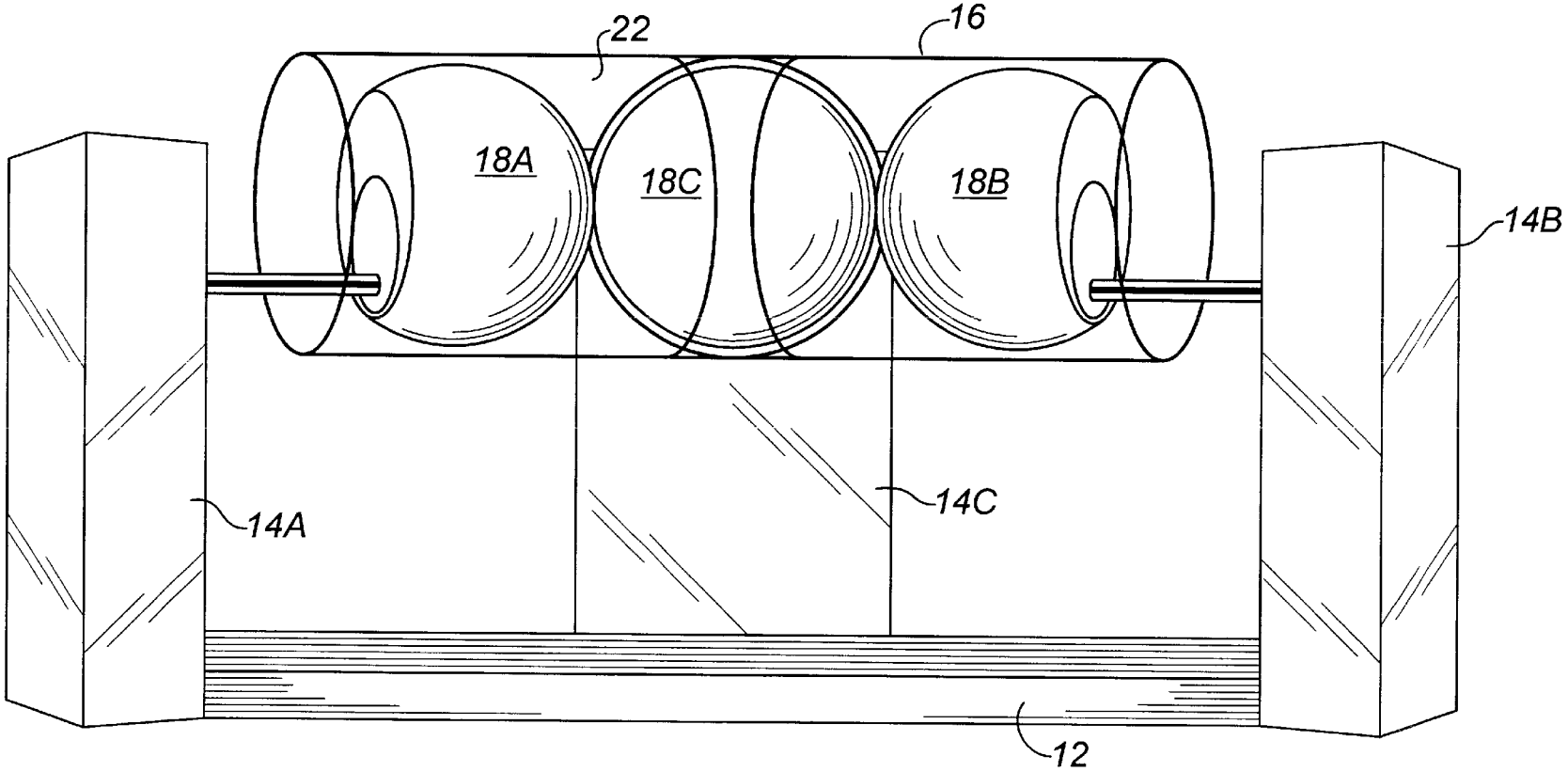
FIG. 10 is a view of the apparatus showing an upward thrusting motion.
Figure 11:
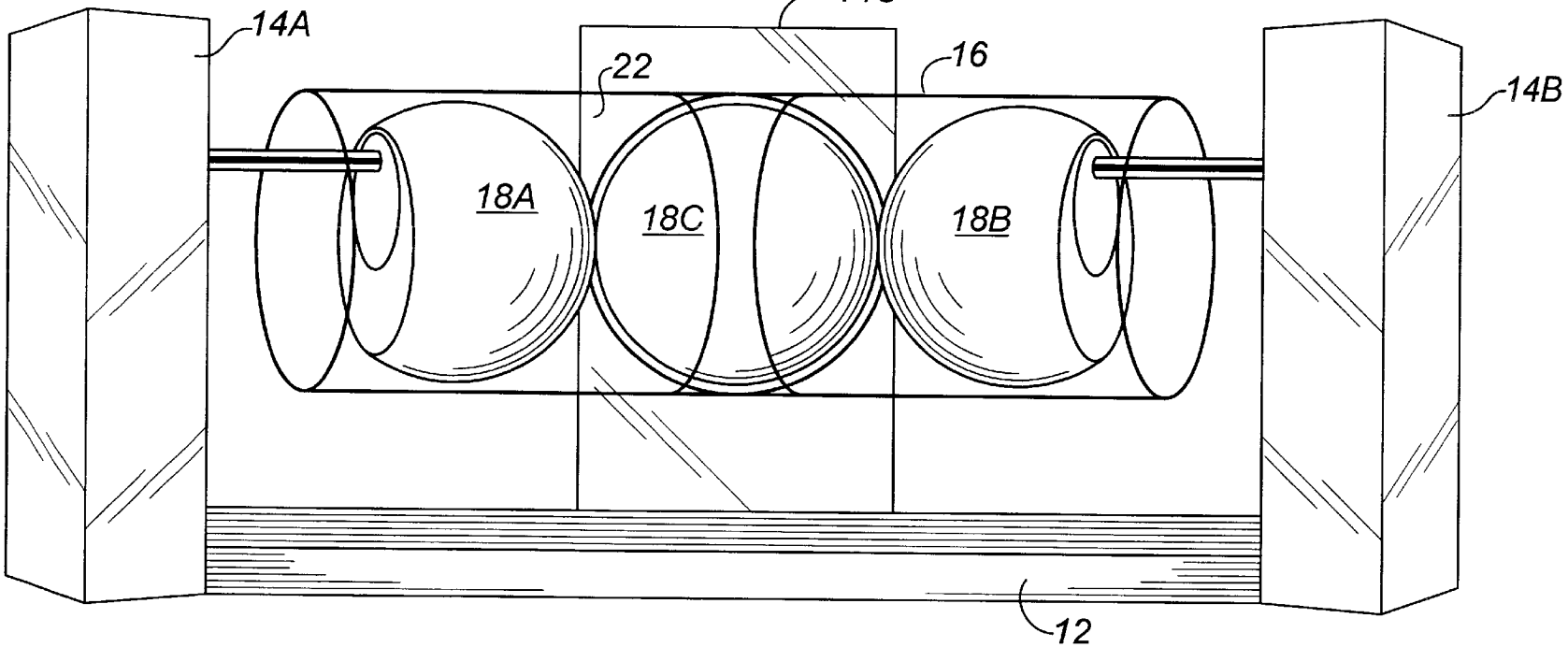
FIG. 11 is a view of the apparatus showing a downward thrusting motion.

An example of an apparatus with three degrees of freedom of movement shown at rest or in a neutral position in FIG. 2. Each of the ball and cam assemblies in this embodiment has a horizontal offset axis (OA). An example of a rolling motion is shown in FIG. 9, where the ball and cam assembly associated with leg 14A has caused ball 18A to move up while the ball and cam assembly associated with leg 14B has caused ball 18B to move downwards. An example of a thrusting motion upward is shown in FIG. 10. An example of a thrusting motion downward is shown in FIG. 11. A pitching motion may be created by causing the forward ball and cam assembly associated with leg 14C to raise or lower the platform relative to the two other ball and cam assemblies. If the two other ball and cam assemblies are at the same height, no roll is induced.

Figure 12:
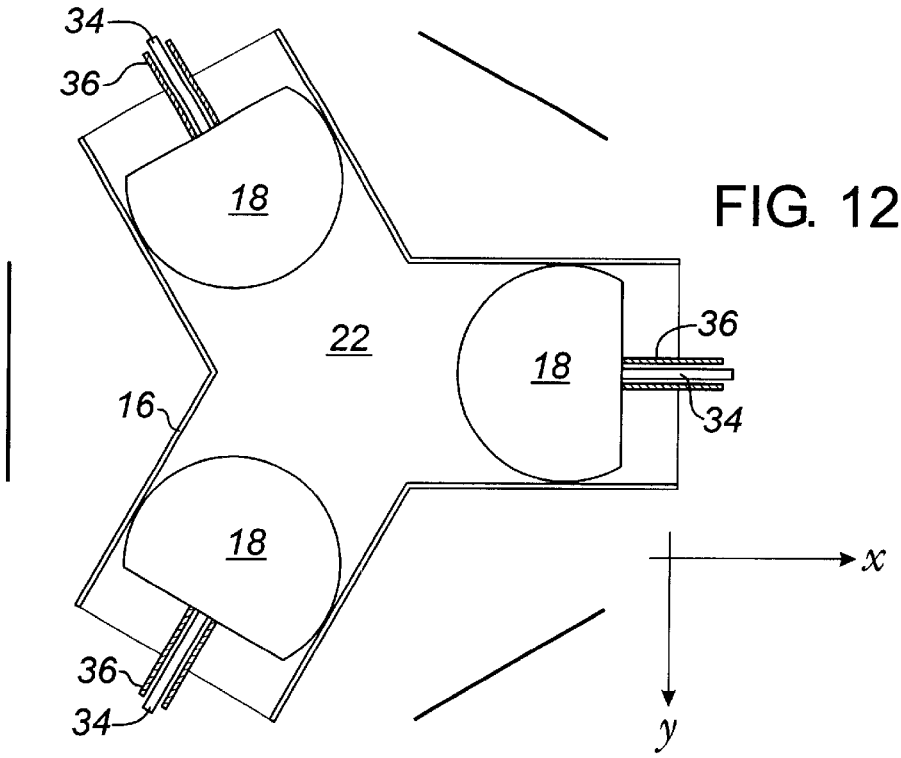
FIG. 12 is a top view of the apparatus in a neutral position.
Figure 13:
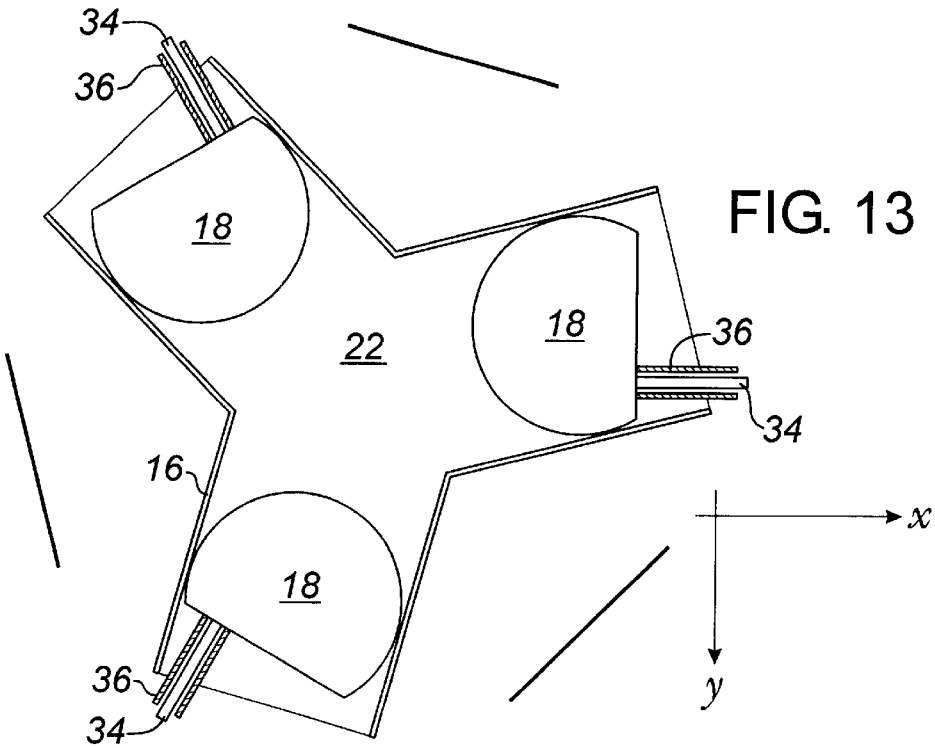
FIGS. 13 and 14 are top views of the apparatus showing yawing motions.
Figure 14:
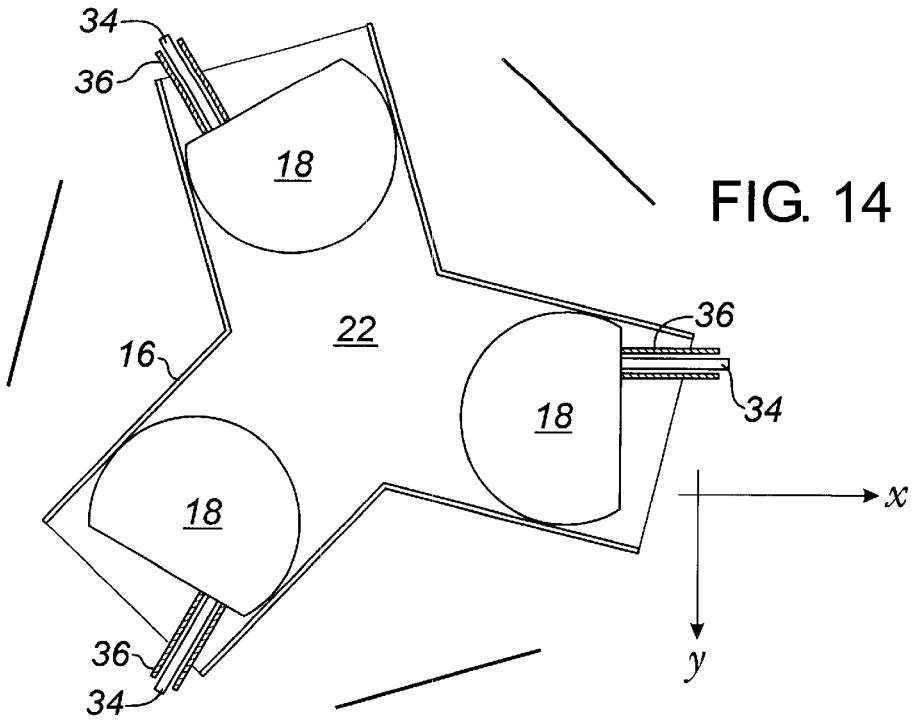
Figure 15:
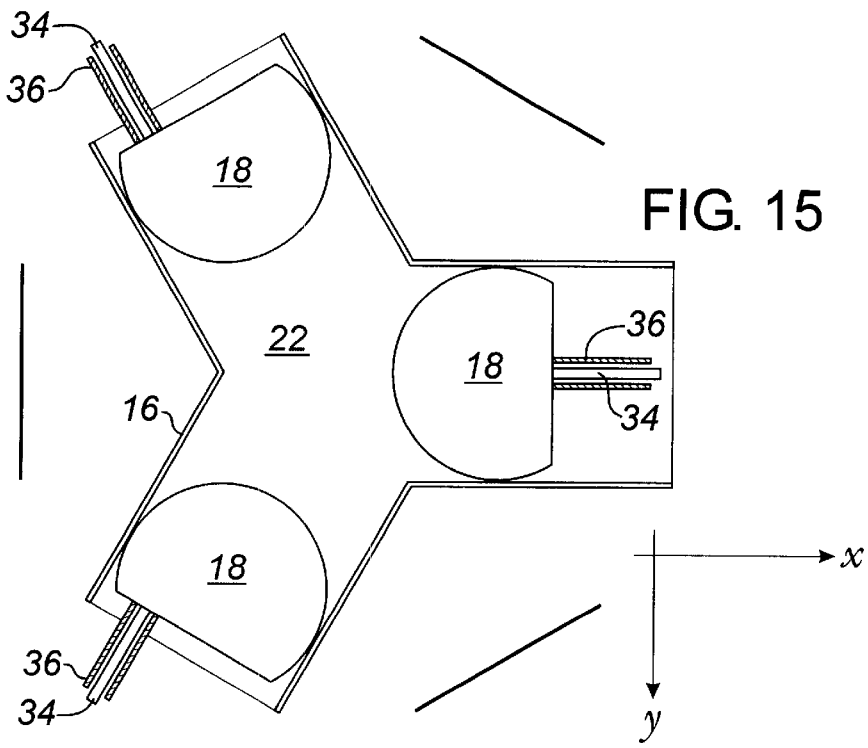
FIGS. 15 and 16 are top views of the apparatus showing a swaying motion.
Figure 16:
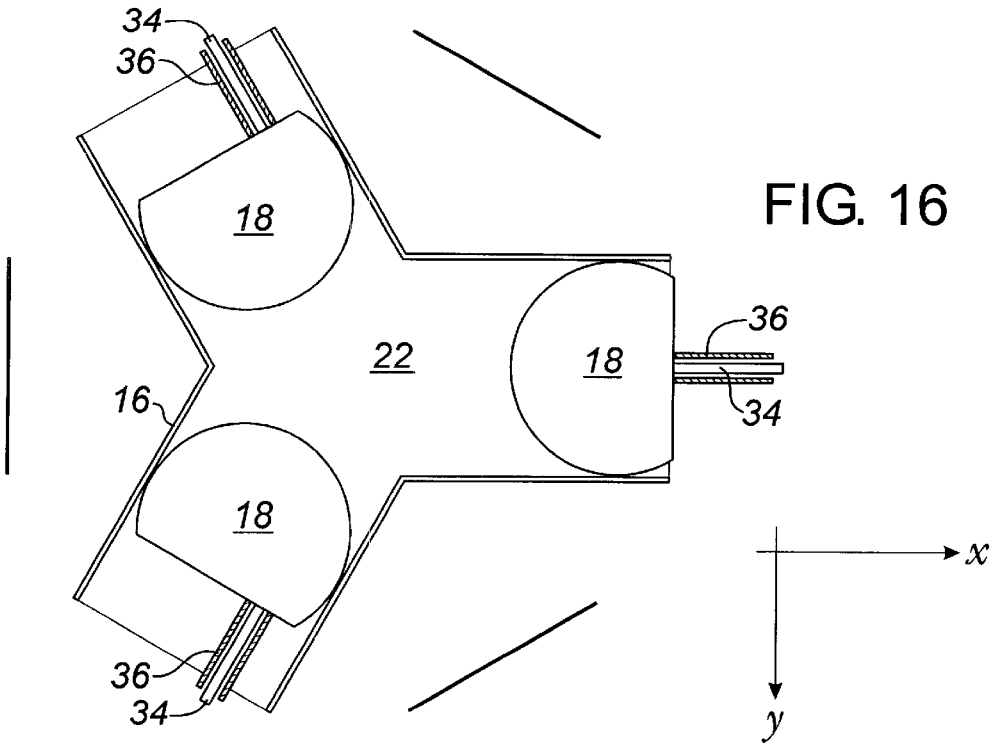
Figure 17:
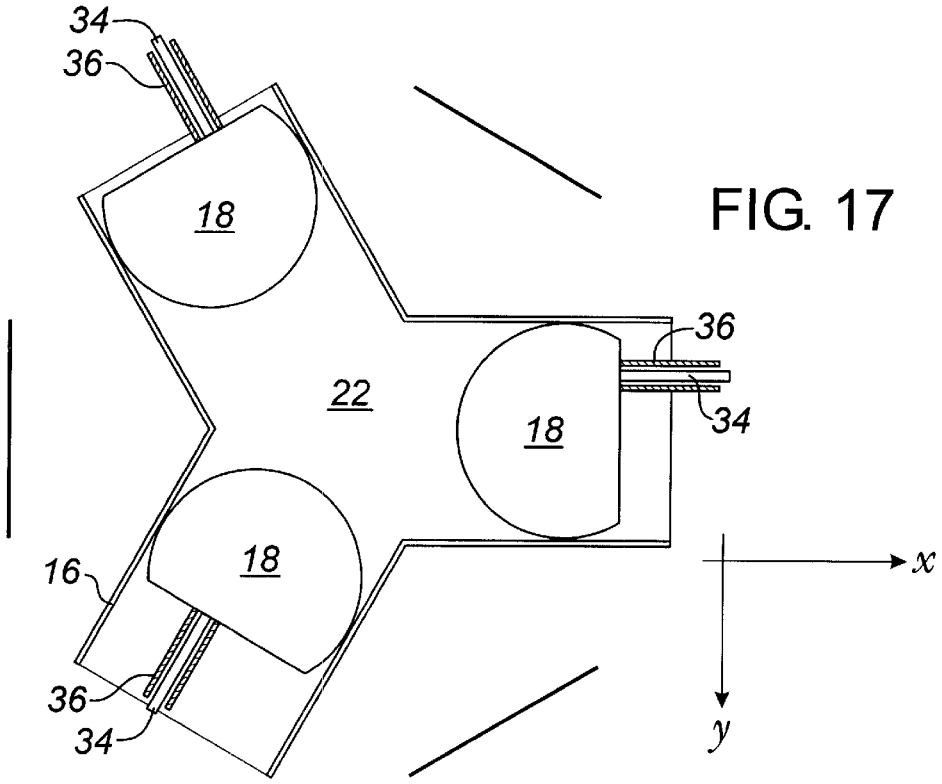
FIGS. 17 and 18 are top views of the apparatus showing a surging motion.
Figure 18:
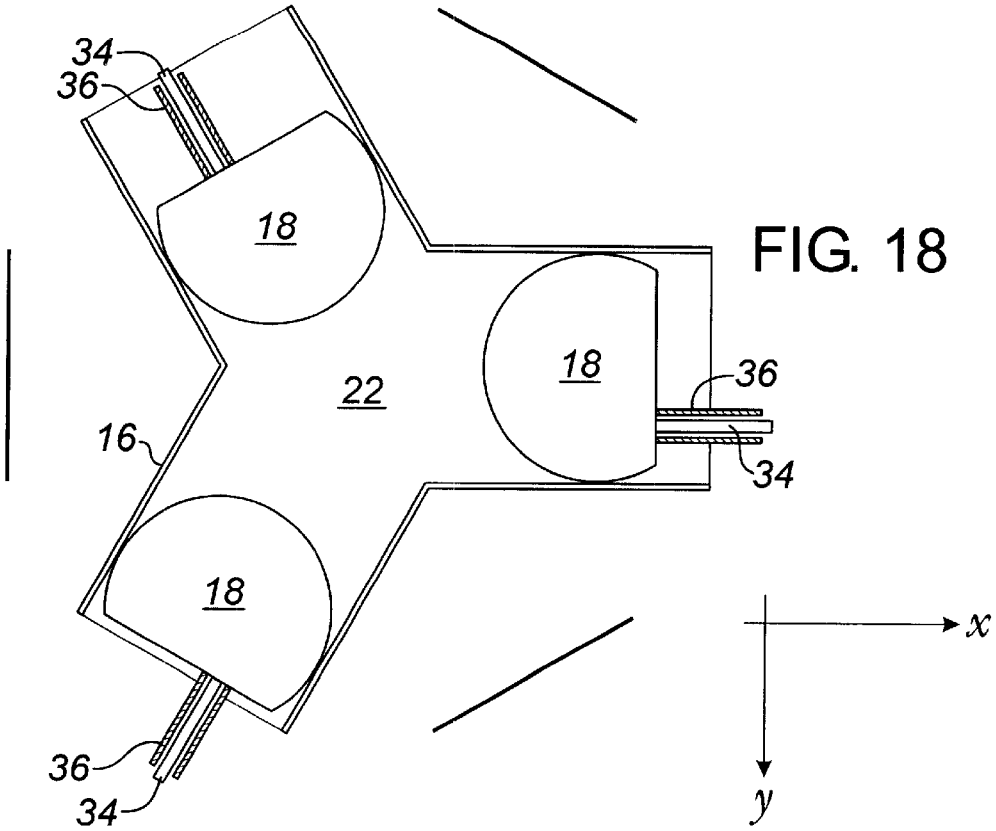

In FIGS. 12 to 18, schematic views of the apparatus from overhead, or along the z axis are shown. FIG. 12 shows the apparatus in a neutral position. An example of a yawing motion in the clockwise direction is shown in FIG. 13 while FIG. 14 shows an example of a yawing motion in the counter-clockwise direction. In FIGS. 15 and 16, an example of a swaying motion is shown. FIGS. 17 and 18 show examples of a surging motion. In all of these examples, the platform moves along and remains parallel to the x-y plane.

As will be appreciated by one skilled in the art, movement of the platform in any combination of the six degrees of freedom may be controlled by controlling the movement and position of each ball to each other. The movement of each ball may be controlled by controlling the rotation of the inner and outer shafts of the ball and cam assembly.

Figure 19:
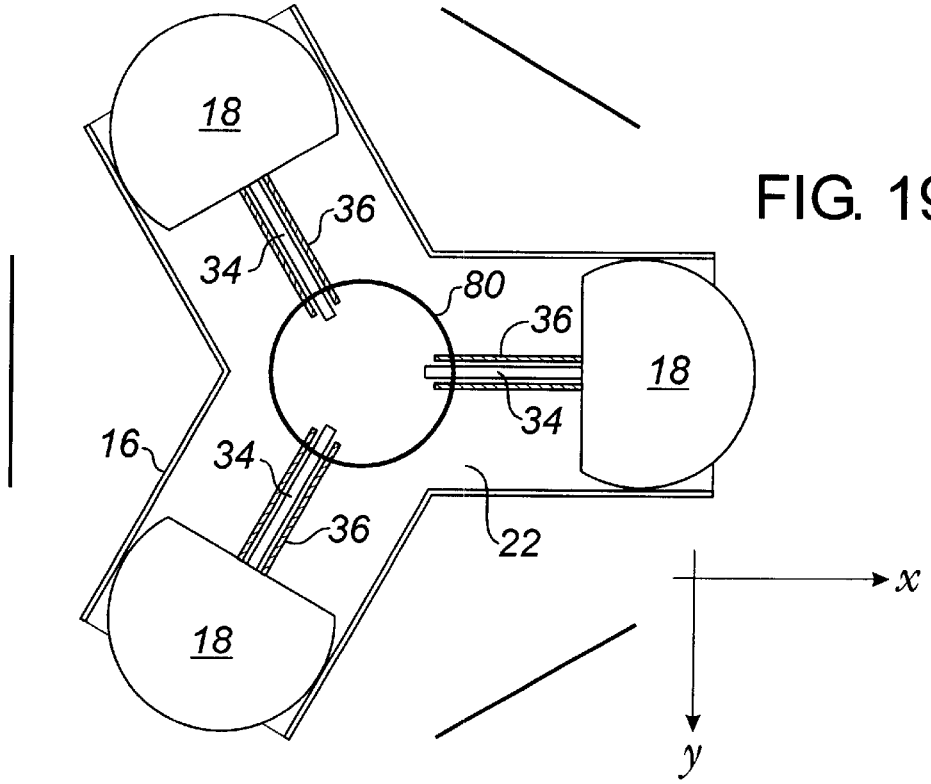
FIG. 19 is a view of an alternative embodiment of the apparatus.

In another alternative embodiment schematically shown in FIG. 19, the base may have only a single central tower (80) for supporting the ball and cam assemblies and the platform. In this embodiment, the shafts (34, 36) radiate outward from the central tower. Optionally, the inner shafts may pass through the balls and sockets to be supported at the periphery of the base by outer struts (not shown). Alternatively, or in addition to support struts, the platform may be counterbalanced by coil springs or the like at the periphery of the platform.

Figure 20:
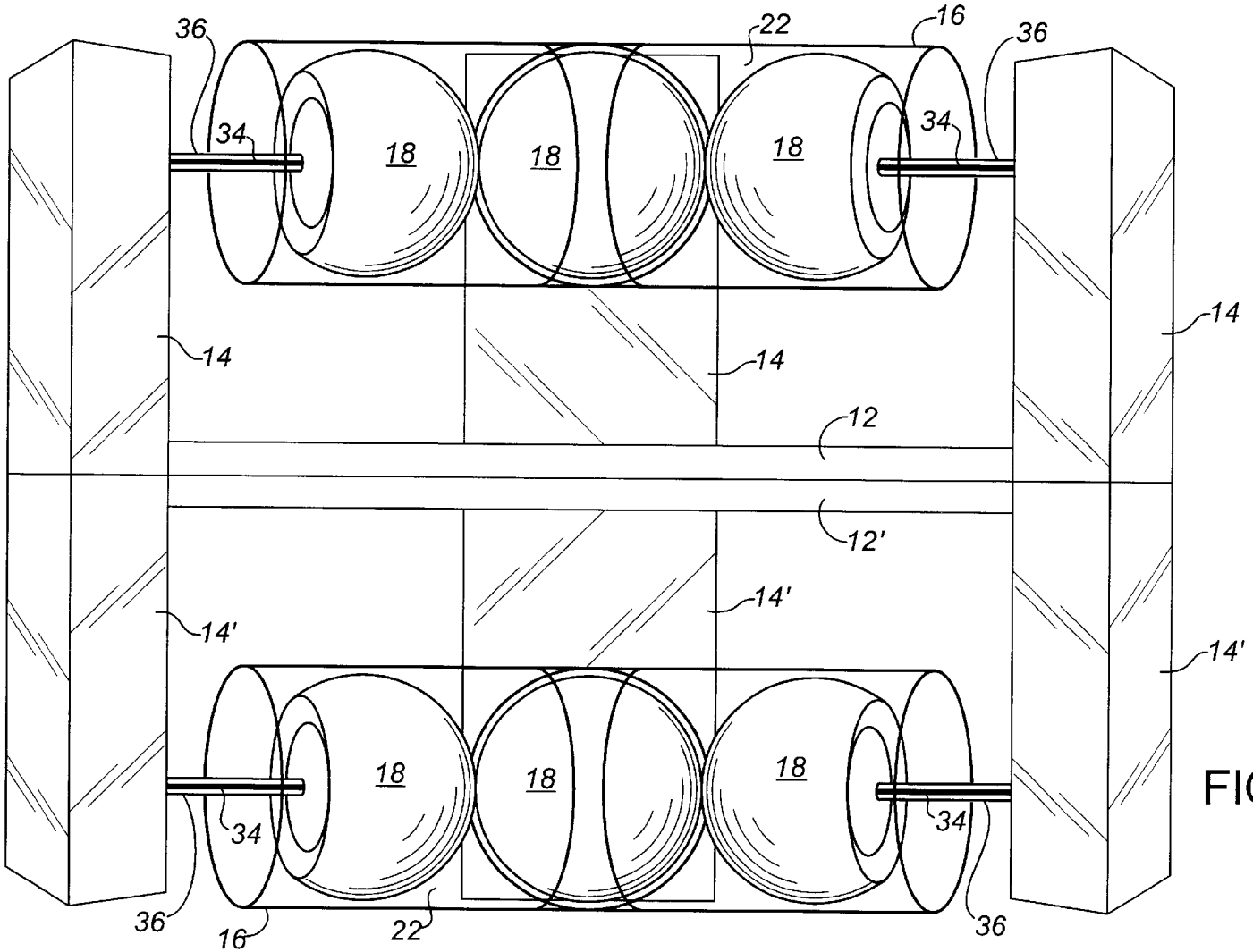
FIG. 20 is a view of an alternative embodiment comprising two apparatuses joined at their bases.

In an alternative embodiment, two apparatuses may be stacked together to increase the range of motion. In one particular variation, the two apparatuses are joined together with the bases (12, 12') of each attached to each other, such that one is inverted from the other, as is shown in FIG. 20. In this embodiment, a single motor may be used to drive equivalent shafts of the lower and upper apparatuses. For example, a single motor may drive both the inner shaft of leg 14 and the inner shaft of leg 14'. In this case, the range of motion caused by an input signal may be doubled because of the duplicated motion of each of the upper and lower apparatuses.

The description of each of the above embodiments is in reference to a motion simulator or a device which moves the platform as a result of an input signal. As will be apparent to one skilled in the art, the same apparatus may readily be adapted to produce an output signal by translating motion of the platform. For example, if a joystick style handle (not shown) is attached to the platform, the handle may be manipulated by the user. As a result, rotary movement will be induced in the shafts which may be mechanically transmitted within the base structure. Suitable sensors or signal feedback devices such as electrical potentiometers may be provided instead of the motors which sense such movement and create an output signal as a result. In this manner, the apparatus may be used as a remote control device for machines or robots or as a joystick controller for video games or the like.

If the apparatus is used as a controller, it may be desirable to physically limit movment of each ball and cam assembly to prevent jamming when the ball and cam assembly is maximally displaced in any direction. Alternatively, a biasing means such as a centering spring (not shown) which urges the shafts back to a neutral position may assist in preventing such maximal displacement jamming.

The claimed invention is not restricted to the motion linkage apparatus used as a motion simulator not is it restricted to the apparatus used as a controller or remote control device. The claimed invention is the motion linkage regardless of its application or in which direction motion is translated.

As will be apparent to those skilled in the art, various modifications, adaptations and variations of the foregoing specific disclosure can be made without departing from the scope of the present invention.

What is claimed is:

1. A motion linkage apparatus having an x axis, a y axis and a z axis, each of which axes is perpendicular to each other, said apparatus comprising:

(a) a base having a central leg substantially in the "z" axis;

(b) at least three shaft and ball assemblies associated with the central leg, each assembly comprising:

(i). ball having a spherical outer surface and a centreline parallel to the "x-y" plane; and (ii). a rotating shaft fixed to the ball parallel to but offset from the centreline of the ball;

wherein the axes of the shafts converge on a centre point and radiate outward from the leg and wherein rotation of the shaft displaces the ball eccentrically about the axis of the shaft; and (c) a platform which has an outer circumference and at least three receptacles, wherein each receptacle engages a corresponding ball such that movement of each ball causes movement of the platform; and (d) means for independently rotating each shaft associated with the base or leg.

2. The apparatus of claim 1 wherein there are at least three legs located about a periphery of the base instead of a single central leg; at least three shaft and ball assemblies wherein each leg is associated with a shaft and ball assembly, wherein each shaft radiates inwardly and the axes of the at least three shafts converge at a central point; and at least three cylindrical sockets wherein each socket rotatably receives a ball.

3. A motion linkage apparatus having an x axis, a y axis and a "z" axis, each of which axes is perpendicular to the other axes, said apparatus comprising:

(c) a base having a central leg substantially in the "z" axis;

(d) at least three ball and cam assemblies associated with the leg, each comprising:

vii. a ball having a spherical exterior surface, a centreline parallel to the "x-y" plane and a cylindrical cavity having a centroidal axis which is parallel to but offset from the centreline of the ball;

viii. a cam which is rotatably mounted within the ball cavity;

ix. an inner shaft attached to the cam in an offset position, for rotating the cam about an axis defined by the inner shaft, wherein said inner shaft axis is coaxial with the centreline of the ball;

x. an outer shaft which is coaxial with and which may rotate independently of the inner shaft, wherein said outer shaft has a fixed pinion gear and rotates the ball by means of the pinion gear meshing with a circular inner gear attached to the ball;

xi. wherein the axes of the inner and outer shafts converge on a centre point and radiate outward; and xii. wherein rotation of the inner shaft relative to the outer shaft causes the centreline of the ball to be displaced relative to the axis of the inner and outer shafts;

(i) means for counter-rotating each inner shaft and a corresponding outer shaft such that the ball and cam counter-rotate at the same rate; and (j) a platform having at least three ball sockets wherein each ball rotatably engages a ball socket.

4. The apparatus of claim 3 wherein there are at least three legs located about a periphery of the base instead of a single central leg; at least three ball and cam assemblies wherein each leg is associated with a ball and cam assembly, wherein each shaft radiates inwardly and the axes of the at least three inner and outer shafts converge at a central point; and at least three cylindrical sockets wherein each socket rotatably receives a ball.

5. The apparatus of claim 4 wherein the inner shafts pass through each ball and are each supported by a strut.

6. The apparatus of claim 5 wherein there is a single strut centrally located on the base which supports each inner shaft.

7. The apparatus of claim 4 wherein each inner shaft and each outer shaft are rotatable independently of each other such that platform may be moved in six degrees of freedom.

8. The apparatus of claim 7 wherein the apparatus is adapted for use as remote control device or as a joystick-style controller where movement of the platform causes rotation of the shafts and the apparatus comprises a sensor or signal feedback device in replacement of the means for counter-rotating the shafts.

9. A motion linkage apparatus comprising the combination of two apparatuses as claimed in claim 3 which are joined together at their bases such that one is inverted to the other.

10. The apparatus of claim 9 wherein each shaft in one apparatus is driven by a motor which also drives the equivalent shaft in the other apparatus.

11. The apparatus of claim 3 wherein the apparatus is adapted for use as remote control device or as a joystick-style controller where movement of the platform causes rotation of the shafts and the apparatus comprises a sensor or signal feedback device in replacement of the means for counter-rotating the shafts.

* * * * *